US005142335A

United States Patent [19]

Sakata et al.

[11] Patent Number: 5,142,335

[45] Date of Patent: Aug. 25, 1992

[54] ELECTROSTATIC LATENT IMAGE-DEVELOPING DEVICE AND TONER CARTRIDGE USED THEREFOR

[75] Inventors: Hiromi Sakata, Suita; Toshinori Nishimura, Hirakata; Yasuyuki Ishiguro, Osaka; Shingo Mori, Nara; Yasuyuki Hirai, Yao, all of Japan

[73] Assignee: Mita Industrial Co., Ltd., Osaka, Japan

[21] Appl. No.: 794,575

[22] Filed: Nov. 19, 1991

[30] Foreign Application Priority Data

Nov. 26, 1990 [JP] Japan ..... 2-323454

[51] Int. Cl.[5] ..... G03G 15/08

[52] U.S. Cl. ..... 355/260; 222/DIG. 1; 222/544

[58] Field of Search ..... 355/260, 245; 222/DIG. 1, 544, 559, 541

[56] References Cited

U.S. PATENT DOCUMENTS

| | | | |
|---|---|---|---|
| 4,491,161 | 1/1985 | Tamura et al. | 222/DIG. 1 |
| 4,573,614 | 3/1986 | Ozawa | 222/541 X |
| 4,614,286 | 9/1986 | Yamaguchi et al. | 222/541 X |
| 4,615,608 | 10/1986 | Mizutani | 222/544 X |
| 4,799,608 | 1/1989 | Oka | 222/541 X |
| 4,895,104 | 1/1990 | Yoshino et al. | 355/260 X |
| 4,961,450 | 10/1990 | Furuta | 222/541 X |
| 4,962,385 | 12/1977 | Katusha et al. | 222/DIG. 1 |
| 4,981,218 | 1/1991 | Ban et al. | 355/260 X |
| 5,018,560 | 5/1991 | Tsukamoto | 355/260 X |
| 5,030,998 | 7/1991 | Shibata et al. | 355/260 |
| 5,040,024 | 8/1991 | Fukuda et al. | 355/260 |
| 5,080,745 | 1/1992 | Paull | 222/DIG. 1 |

FOREIGN PATENT DOCUMENTS

| | | | |
|---|---|---|---|
| 63-137258 | 6/1988 | Japan | 355/260 |
| 63-243978 | 10/1988 | Japan | 355/260 |
| 2-115876 | 4/1990 | Japan | 355/260 |
| 2-196260 | 8/1990 | Japan | 355/260 |
| 2-223976 | 9/1990 | Japan | 355/260 |
| 3-4260 | 1/1991 | Japan | 355/260 |

*Primary Examiner*—R. L. Moses

*Attorney, Agent, or Firm*—Beveridge, DeGrandi & Weilacher

[57] ABSTRACT

An electrostatic latent image-developing device is equipped with a toner cartridge-holding means and a toner cartridge fitted thereto. The toner cartridge includes a container with a toner discharge openings, a toner contained in the container, and a sealing means for sealing the toner discharge opening. The sealing means is constituted by a tape member that is provided to move across the toner discharge opening, and a toner passage opening is formed in the tape member. The toner discharge opening is opened when the tape member is so moved that the toner passage opening is positioned at the toner discharge opening. The toner cartridge-holding means includes a hoist frame that moves up and down, and the toner cartridge is held in this hoist frame.

24 Claims, 13 Drawing Sheets

ELECTROSTATIC LATENT IMAGE-DEVELOPING DEVICE AND TONER CARTRIDGE USED THEREFOR

FIELD OF THE INVENTION

The present invention relates to an electrostatic latent image-developing device utilized for an image-forming machine such as an electrostatic copying machine or a laser printer. More specifically, the invention relates to an electrostatic latent image-developing device of a type which is replenished with toner by renewing a toner cartridge and to the toner cartridge used for such an electrostatic latent image-developing device.

DESCRIPTION OF THE PRIOR ART

In an electrostatic latent image-developing device used in an image-forming machine, toner is imparted to an electrostatic latent image that is to be developed in order to develop it into a toner image. Therefore, the toner is consumed as the developing is continued, and the electrostatic latent image-developing device must be replenished with the toner after the developing has been executed many times. In general, a toner replenishing system is conveniently employed according to which a toner cartridge is renewed to replenish the toner. The electrostatic latent image-developing device that employs the above toner replenishing system has a toner cartridge-holding means in which the toner cartridge is detachably held. The toner cartridge-holding means has an opening for receiving the toner. The toner cartridge includes a container having a toner discharge opening, toner contained in the container, and a sealing means for sealing the toner discharge opening. Usually the toner discharge opening is formed in the lower wall of the container, and the sealing means is constituted by a tape member which is peelably stuck to the lower wall of the container. When the toner cartridge is fitted to a predetermined fitting position of the toner cartridge-holding means, the toner discharge opening of the toner cartridge is positioned to face the opening for receiving the toner of the toner cartridge-holding means. After the toner cartridge is fitted to the predetermined position of the toner cartridge-holding means, the tape member is peeled off from the container to open the toner discharge opening. Then, the toner in the container is discharged into the toner-receiving opening through the toner discharge opening, so that the electrostatic latent image-developing device is replenished with the toner. The tape member is peeled off from the container usually by gripping its end and pulling it off.

Japanese Laid-Open Utility Model Publication No. 224364/1983 discloses a toner cartridge in which a slide member is fitted to the container in relation to the toner discharge opening of the container, and the tape member stuck to the container is linked to the slide member. In such a toner cartridge, the slide member is moved in a predetermined direction relative to the container, whereby the tape member is peeled off from the container and the toner discharge opening is opened. When the toner cartridge is to be removed from the toner cartridge-holding means, the slide member is returned back to the initial position to cover the toner discharge opening with the tape member.

However, the conventional electrostatic latent image-developing device that is replenished with the toner by renewing the toner cartridge has the following problems that must be solved; i.e., (1) The tape member for opening the toner discharge opening is not always easily peeled off and at this occasion, the toner is often scattered around to contaminate the operator's clothes.

(2) The toner discharge opening is not reliably closed when the toner cartridge is removed from the toner cartridge-holding means, and the toner remaining in the toner cartridge often scatters around or contaminates the operator's cloths.

(3) The electrostatic latent image-developing means is disposed in the housing of an image-forming machine, and the toner cartridge must be taken out from the housing of the image-forming machine to take it out from the toner cartridge-holding means. Again, the toner cartridge must be brought into the housing of the image-forming machine to fit it to the toner cartridge-holding means. Therefore, it is not easy to take out or fit the toner cartridge.

(4) According to the toner cartridge disclosed in the above Japanese Laid-Open Utility Model Publication No. 224364/1983, the slide member is returned back to the initial position to re-close the toner discharge opening by the tape member. However, it is not easy to return the slide member back to the initial position under the condition where the toner cartridge is fitted to the predetermined fitting position of the toner cartridge-holding means.

(5) According to the toner cartridge disclosed in the above Japanese Laid-Open Utility Model Publication No. 224364/1983, at the time when the toner discharge opening is to be opened or closed, the portion where the toner discharge opening is closed under the initial condition is moved, i.e., the portion to where the toner is adhered in no small quantity is moved in an outwardly exposed state, permitting the toner to scatter around.

(6) According to the toner cartridge disclosed in the above Japanese Laid-Open Utility Model Publication No. 224364/1983, the slide member moved to one side of the container must be held at its position deviated from the toner discharge opening to maintain it instead of discarding it away. This causes the toner cartridge-holding means to become extremely bulky.

SUMMARY OF THE INVENTION

A first object of the present invention is to provide an improved electrostatic latent image-developing device that is capable of opening the toner discharge opening without requiring cumbersome operation and without causing the toner to be scattered, and to provide a toner cartridge that can be used for the above electrostatic latent image-developing device.

A second object of the present invention is to provide an improved electrostatic latent image-developing device which is capable of very easily and reliably closing the toner discharge opening to fully reliably prevent the toner remaining in the container from scattering around at the time of taking the toner cartridge out of the toner cartridge-holding means, and to provide a toner cartridge used for the above electrostatic latent image-developing device.

A third object of the present invention is to provide an improved electrostatic latent image-developing device which makes it easy to take out the toner cartridge from the toner cartridge-holding means and to fit the toner cartridge to the toner cartridge-holding means.

A fourth object of the present invention is to provide an improved electrostatic latent image-developing device which is capable of very easily opening the toner discharge opening of the toner cartridge and very easily closing the opened toner discharge opening without making the toner cartridge-holding means to be excessively bulky and without permitting the toner to scatter around.

According to one aspect of the present invention, the sealing means is constituted by a tape member that moves across the toner discharge opening of the container, a toner passage opening is formed in the tape member, and the toner passage opening is positioned at the toner discharge opening by moving the tape member, so that the toner is discharge from the container through the toner discharge opening and the toner passage opening.

It is desired that the toner cartridge is provided with a take-up means, and the front end of the tape member is connected to the take-up means. It is further preferred that the take-up means is provided with an input means, the toner cartridge-holding means is provided with an output means that is connected to a drive source, and the output means and the input means are drivably coupled together when the toner cartridge is fitted to the predetermined position of the toner cartridge-holding means, so that the take-up means is driven by the drive source to move the tape member.

Desirably, the toner cartridge is provided with a delivering means and a guide means disposed on the side of one edge of the toner discharge opening, and the take-up means is disposed on the side of other edge of the toner discharge opening. A preferred example of tape member constituting the sealing means includes a sealing portion that extends across the toner discharge opening of the container under the initial condition and is peelably stuck to the container over a region surrounding the toner discharge opening, a passage opening portion which is positioned behind the sealing portion and in which the toner passage opening is formed, a front portion that is folded back at the front edge of the sealing portion, passes along the outer side thereof, turns around the guide means, and further extends to the take-up means, and a tentative sealing portion position behind the passage opening. It is preferred that the rear end of the toner passage opening formed in the tape member becomes gradually narrow toward the rear side.

According to another aspect of the invention, a hoist means is disposed in the toner cartridge-holding means to move the toner cartridge up and down between the predetermined fitting position and an elevated position raised from the fitting position.

A preferred example of the hoist means includes a hoist frame that is mounted to move up and down, and the toner cartridge is fitted to the hoist frame. It is desired that the toner cartridge-holding means has a bottom wall in which an opening is formed to receive the toner, a buffer member is disposed on the bottom wall, the toner discharge opening is formed in the lower wall of the container of the toner cartridge, and the lower wall of the container is pressed onto the buffer member when the toner cartridge is lowered to the fitting position by the action of the hoist means.

Preferably, an opening closed by a covering member is arranged over the toner cartridge-holding means so as to be freely opened and closed, and the toner cartridge partly protrudes upwardly beyond the above port when the covering member is opened and the toner cartridge is raised to the elevated position.

In the electrostatic latent image-developing device and the toner cartridge used therefor constituted according to one aspect of the present invention, the toner passage opening formed in the tape member is positioned at the toner discharge opening by moving the tape member that constitutes the sealing member, so that the toner discharge opening is opened and the toner is discharged from the container passing through the toner discharge opening and the toner passage opening. The tape member is moved by the take-up means disposed in the toner cartridge, and the take-up means is driven by the drive source disposed in the toner cartridge-holding means via output means disposed in the toner cartridge-holding means and input means disposed in the toner cartridge. Under the initial condition of the tape member, the sealing portion is positioned at the toner discharge opening. Hence, the sealing portion is, of which the inner surface is adhered with toner, taken up by the take-up means without being outwardly exposed. To take out the toner cartridge from the toner cartridge-holding means, the tape member is delivered from the delivering means so that the false-sealing portion is positioned at the toner discharge opening thereby to close the toner discharge opening. Thus, without requiring any cumbersome manual operation and without causing the toner to be scattered around, the toner discharge opening of the toner cartridge can be opened to discharge the toner from the container and, further, the toner discharge opening that is open can be closed again.

In the electrostatic latent image-developing device constituted according to the other aspect of the present invention, the toner cartridge is taken out from the toner cartridge-holding means after the toner cartridge has been raised to the elevated position from the fitting position. Moreover, once the toner cartridge is fitted to the elevated position by hand, the toner cartridge can be lowered to the predetermined fitting position without requiring any additional manual operation. Thus, the toner cartridge can be taken out or fitted very easily when it is outwardly protruded only partly at the elevated position.

DETAILED DESCRIPTION OF PREFERRED EMBODIMENTS

A preferred embodiment of the electrostatic latent image-developing device constituted according to the present invention will now be described in further detail by reference to the accompanying drawings.

Figure 1:
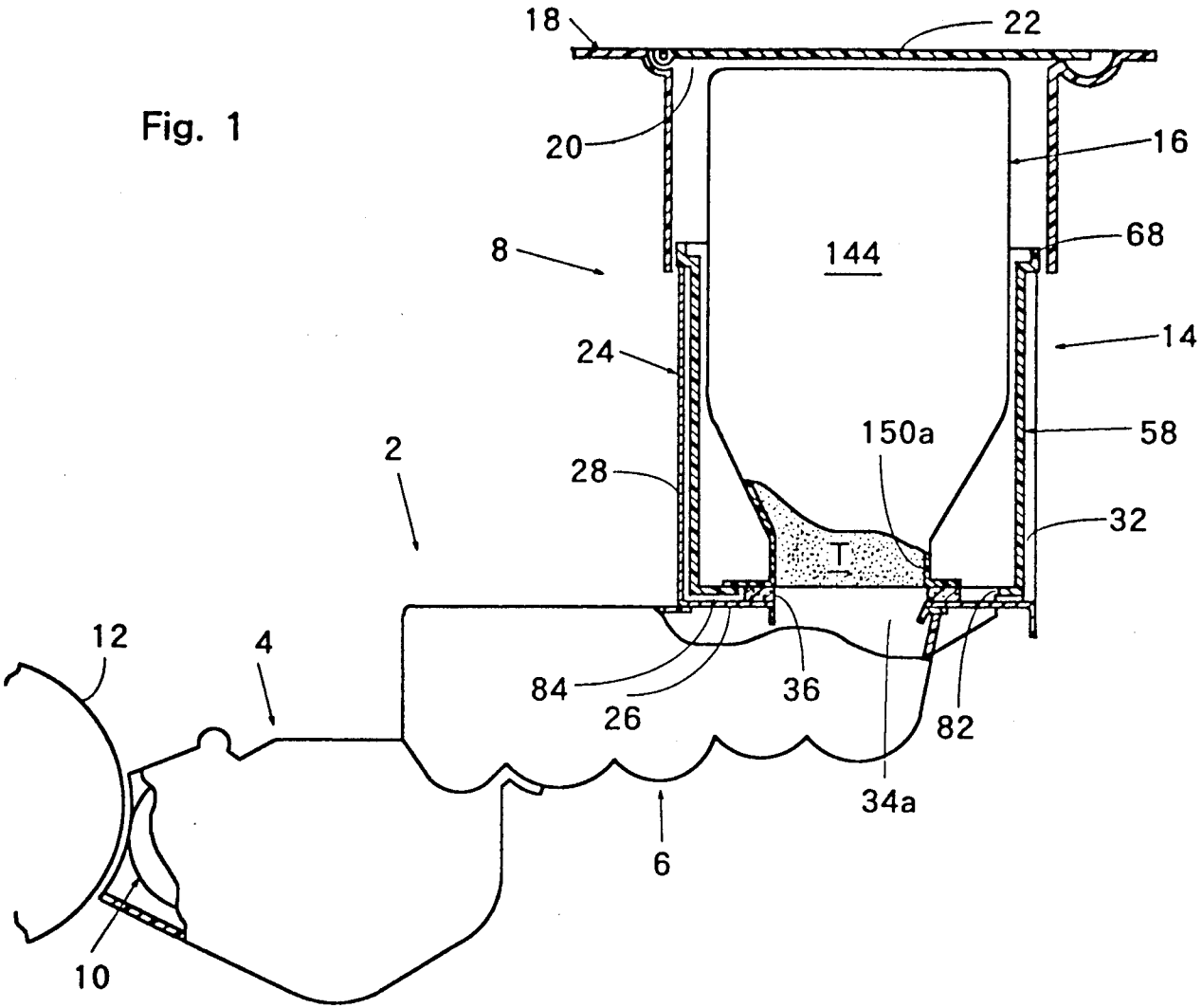
FIG. 1 is a side view illustrating, partly in cross section, a preferred embodiment of an electrostatic latent image-developing device constituted according to the present invention.

With reference to FIG. 1, an electrostatic latent image-developing device generally designated at 2 is constituted by a developing unit 4, a toner carrier unit 6 and a toner feeding unit 8. The developing unit 4 includes a suitable developing mechanism 10 such as a magnetic brush developing mechanism. The developing mechanism applies a developer, which may be a so-called two-component developer consisting of a toner and a carrier, onto a rotary drum 12, in order to develop an electrostatic latent image formed on the rotary drum 12 into a toner image. As the toner is consumed at the developing unit 4, the toner is carried from the toner carrier unit 6 to the developing unit 4. The toner feeding unit 8 is equipped with a toner cartridge-holding means 14 and a toner cartridge 16 detachably fitted into the toner cartridge-holding means 14. As will be described later in further detail, toner T is contained in the toner cartridge 16 and is discharged to the toner carrier unit 6 to the developing unit 4. The electrostatic latent image-developing device 2 and the rotary drum 12 are disposed in a housing 18 (FIG. 1 shows part of it only) of an image-forming machine such as an electrostatic copying machine or a laser printer. The upper wall of the housing 18 is disposed over the electrostatic latent image-developing device 2, and a port 20 is formed in the upper wall of the housing 18 at a position above the toner feeding unit 8. To the upper wall of the housing 18 is fitted one end of a covering member 22 to allow to swing open or close, and the port 20 is closed by the covering member 22 (reference should also be made to FIGS. 5 and 6). The developing unit 4 and the toner carrier unit 6 of the electrostatic latent image-developing device 2 that is illustrated in FIG. 1 do not constitute novel features in the electrostatic latent image-developing device that is improved according to the present invention but may be known constructions. Hence, their detailed constructions are not described in this specification.

Figure 2:
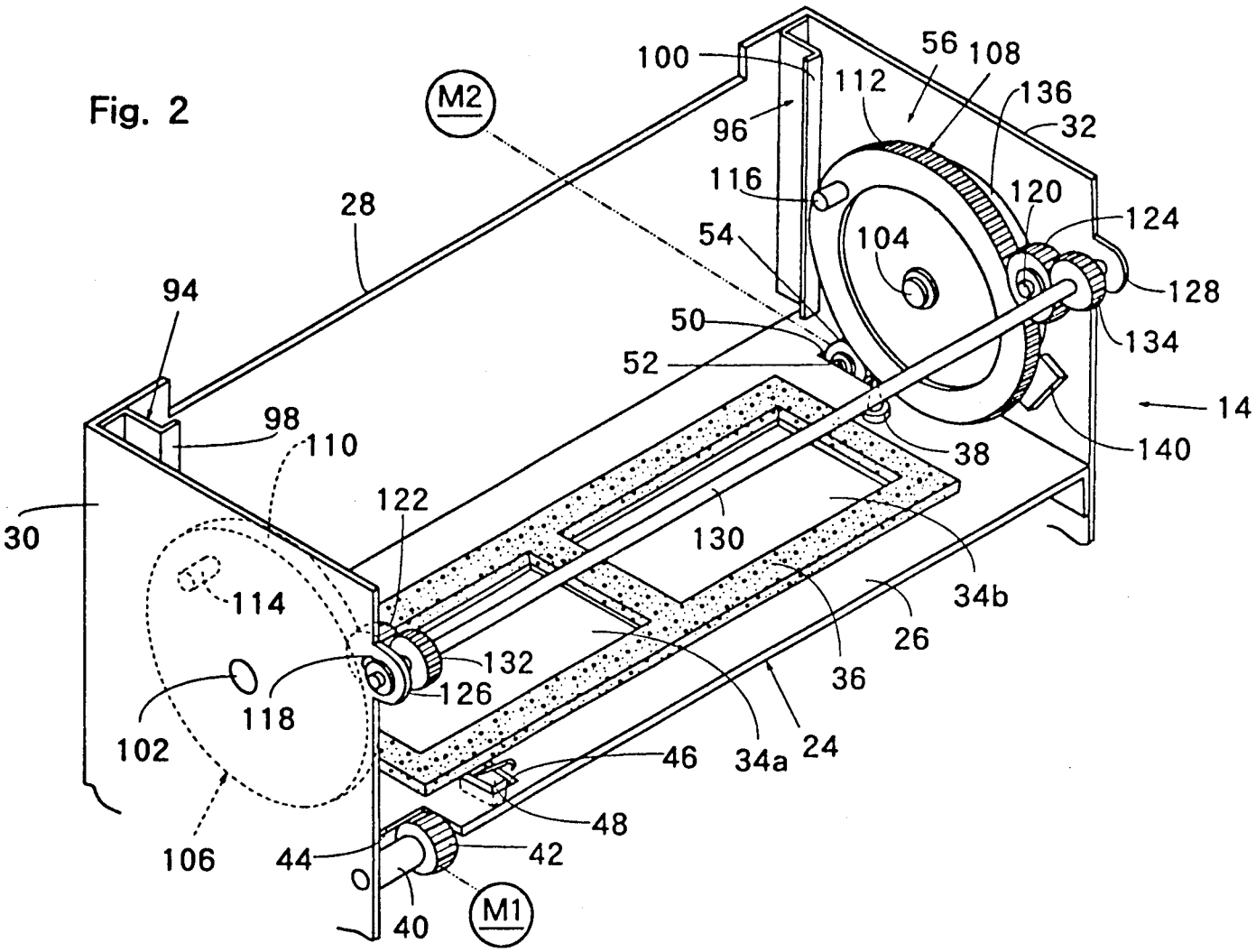
FIG. 2 is a perspective view illustrating a portion of a toner cartridge-holding means in the electrostatic latent image-developing device of FIG. 1.

With reference to FIG. 2 as well as FIG. 1, the toner cartridge-holding means 14 of the toner feeding unit 8 includes a stationary support frame 24. This support frame 24 has a bottom wall 26 that extends substantially horizontally, an upright rear wall 28 that upwardly extends from the rear edge of the bottom wall 26, and upright side walls 30 and 32 that upwardly extend from edges on both sides of the bottom wall 26. Two openings 34*a* and 34*b* for receiving the toner are formed in parallel in the direction of width (perpendicularly to the surface of the paper in FIG. 1) in the central region of the bottom wall 26. The openings 34*a* and 34*b* for receiving the toner are of a rectangular shape. A buffer member 36 is attached to the upper surface of the bottom wall 26 to extend along the periphery of the toner-receiving openings 34*a* and 34*b*. The buffer member 36 is made of a soft material such as a foamed resin. Positioning pins 38 (FIG. 2 shows only one of them) are upwardly protruded at both side portions of the bottom wall 26. The upper portion of the positioning pin 38 has a conical shape. A short shaft 40 that horizontally protrudes is secured to the front portion of the side wall 30, and a gear 42 is rotatably fitted to the short shaft 40. The gear 42 is connected to a drive source M1 which may be an electric motor, via a transmission means (not shown) that includes a gear train. A rectangular notch 44 is formed in one side portion at the front edge of the bottom wall 26, and the gear 42 is allowed to protrude upwardly through the notch 44. As will be described later, the gear 42 constitutes an output means that is drivably coupled to an input means constituted by gears that are disposed in the toner cartridge 16. A rectangular opening 46 is formed adjacent to the notch 44 in the bottom wall 26, and a detection arm of a microswitch 48 attached to the lower surface of the bottom wall 26 protrudes upwardly through the opening 46 (the action of the microswitch 48 will be described later). A rectangular opening 50 is formed in one side portion at the rear edge of the bottom wall 26, and a gear 54 rotatably fitted to a short shaft 52 that is secured to the side wall 32 and extends horizontally protrudes upwardly through the opening 50. The gear 54 is connected to a drive source M2 which may be an electric motor, via a transmission means (not shown) that includes a gear train. To the gear 54 is drivably coupled a gear in a hoist means that will be described later.

Figure 3:
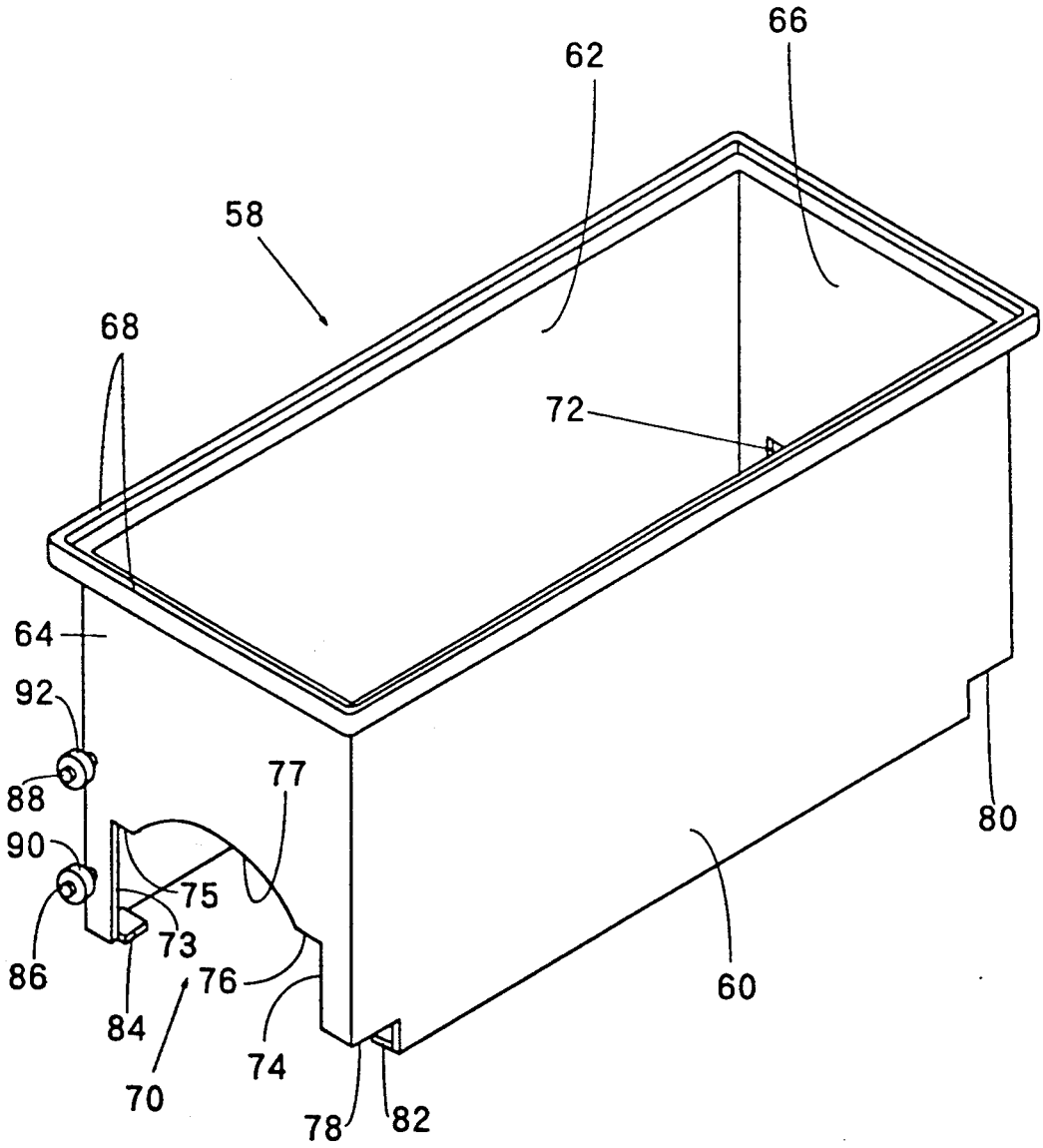
FIG. 3 is a perspective view showing a hoist frame of the toner cartridge-holding means in the electrostatic latent image-developing device of FIG. 1.

With reference to FIG. 3 as well as FIGS. 1 and 2, the toner cartridge-holding means 14 has a hoist means 56 which includes a hoist frame 58. As clearly shown in FIG. 3, the hoist frame 58 is of nearly a rectangular parallelopiped shape having openings in the upper surface and in the lower surface, and further has front and rear walls 60 and 62 as well as side walls 64 and 66. A flange 68 that horizontally protrudes outwardly and then upwardly is formed at the upper ends of the front and rear walls 60, 62 and the side walls 64, 66. Relatively large notches 70 and 72 are formed in the lower portions of the side walls 64 and 66. Each of the notches 70 and 72 has vertical edges 73 and 74 that extend substantially vertically upwards from the lower ends of the side walls 64 and 66 at a predetermined distance in the back-and-forth direction, horizontal edges 75 and 76 that inwardly extend substantially horizontally from the vertical edges 73 and 74, and an arcuate edge 77 that extends arcuately between the horizontal edges 75 and 76. Relatively small rectangular notches 78 and 80 are formed at the lower ends on both sides of the front wall 60. Furthermore, protrusions 82 that protrudes inwardly (FIG. 3 shows only one of them) are formed at the lower ends on both sides of the front wall 60. Protrusions 84 that protrudes inwardly (FIG. 3 shows only one of them) are formed at the lower ends on both sides of the rear wall 62. Short shafts 86 and 88 are formed at the rear portion of each of the side walls 64 and 66 at a distance in the up-and-down direction, and rollers 90 and 92 are rotatably fitted to the short shafts 86 and 88 (FIG. 3 shows only the short shafts 86, 88 and the rollers 90, 92 that are mounted on the side wall 64).

With reference to FIG. 2, guide members 94 and 96 are secured, extending vertically, onto the inner surface of both sides of the rear wall 28 of the support frame 24, the guide members 94 and 96 having restriction portions 98 and 100 that extend substantially vertically. Short shafts 102 and 104 are secured to the side walls 30 and 32 of the support frame 24 and inwardly protrude substantially horizontally. Rotary members 106 and 108 are rotatably fitted to the short shafts 102 and 104. The rotary members 106 and 108 have toothed portions 110 and 112 having teeth formed along the peripheries thereof. Hoist pins 114 and 116 that protrude inwardly and substantially horizontally are studded on the inner surface of the toothed portions 110 and 112. As clearly shown in FIG. 2, the toothed portion 112 of the rotary member 108 is engaged with the gear 54 that is located in the opening 50 formed in the bottom wall 26, and is drivably coupled to the drive source M2 via this gear 54. Short shafts 118 and 120 are further secured to the side walls 30 and 32 of the support frame 24, and gears 122 and 124 are rotatably fitted to the short shafts 118 and 120. The gears 122 and 124 are brought into engagement with the toothed portions 110 and 112 of the rotary members 106 and 108, respectively. A rotary shaft 130 is rotatably mounted across the protruded portions 126 and 128 that are formed at the front edges of the side walls 30 and 32. Gears 132 and 134 are fastened to both ends of the rotary shaft 130, and are brought into engagement with the gears 112 and 124, respectively. Therefore, the rotational driving force transmitted to the rotary member 108 via the gear 54 is further transmitted to the rotary member 106 via toothed portion 112, gear 124, gear 134, rotary shaft 130, gear 132, gear 122 and toothed portion 110, whereby the rotary members 106 and 108 are rotated in the same direction in synchronism with each other. The hoist pins 114 and 116 of the rotary members 106 and 108 are maintained at substantially the same angular positions at all times.

Figure 5:
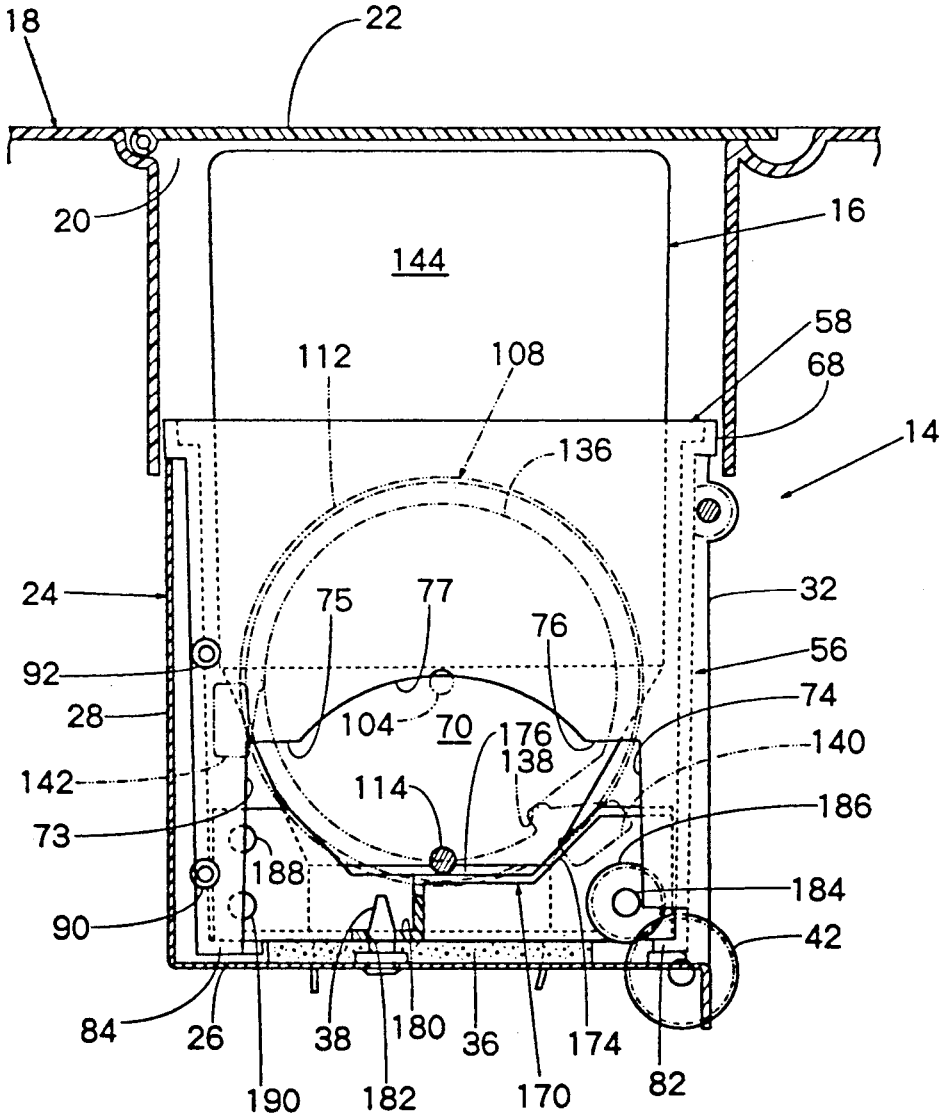
FIG. 5 is a sectional view showing the condition in which the toner cartridge is fitted, as required, to the toner cartridge-holding means in the electrostatic latent image-developing device of FIG. 1.
Figure 6:
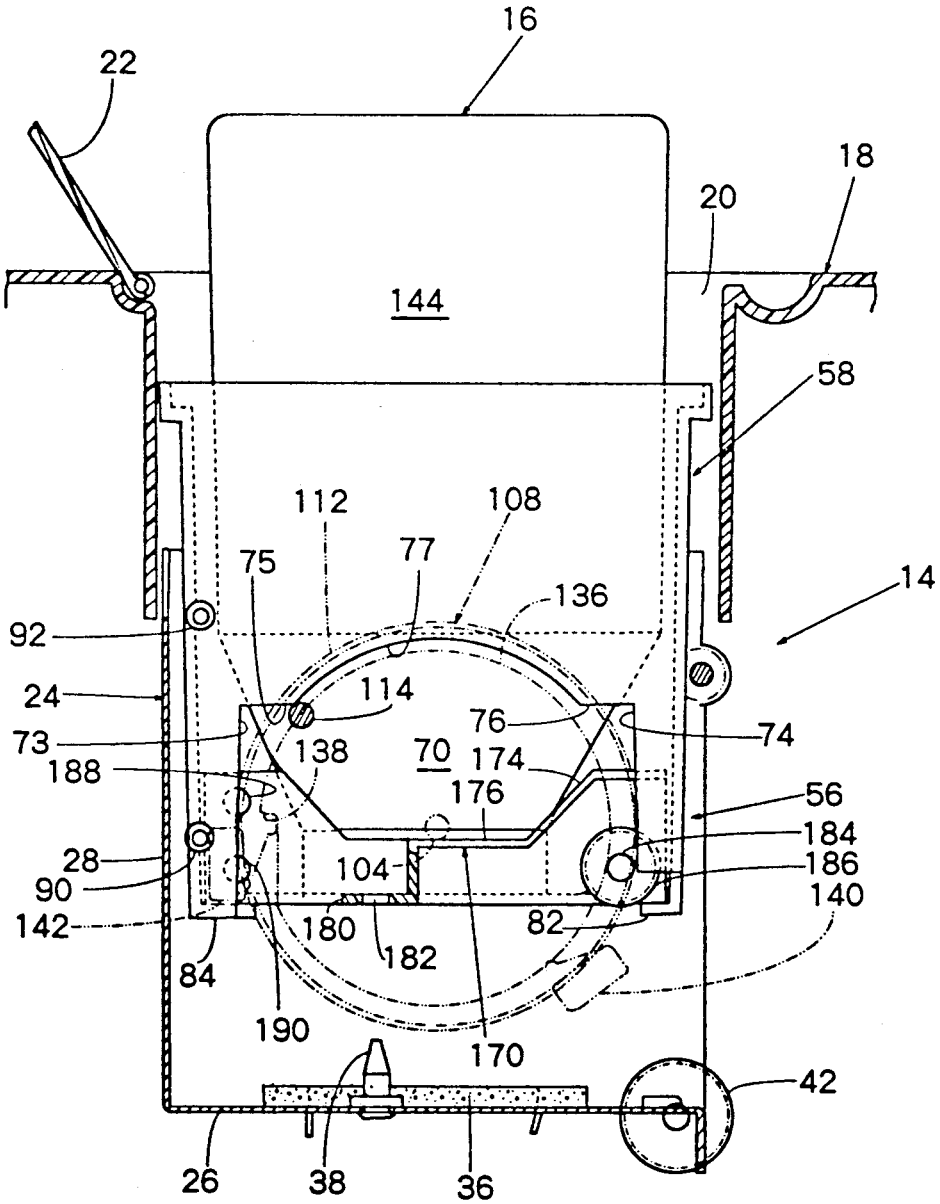
FIG. 6 is a sectional view showing the condition in which the toner cartridge fitted to the toner cartridge-holding means is at an elevated position in the electrostatic latent image-developing device of FIG. 1.

With reference to FIGS. 5 and 6 as well as FIG. 2, a cam portion 136 is formed integrally with the rotary member 108 on the back surface side of the toothed portion 112. The peripheral surface of the cam portion 136 is of a circular shape except a recessed portion 138 that is to be detected. Two microswitches 140 and 142 are mounted on the inner surface of side wall 32 of the support frame 24, in relation to the cam portion 136. The switches 140 and 142 detect the recessed portion 138 to be detected of the cam portion 136 (the switches 140 and 142 are opened when their detection arms are positioned in the recessed portion 138 to be detected), thereby to detect the rotational angular position of the rotary member 108 (and the rotary member 106).

The above-mentioned hoist frame 58 has rollers 90 and 92 attached to the outer surfaces of the side walls 64 and 66. The rollers 90 and 92 are positioned behind the restriction portions 98 and 100 of guide members 94 and 96 arranged at the rear edges on both sides of the support frame 24, whereby the hoist frame 58 is fitted to the support frame 24, being allowed to ascend and descend freely. When the hoist frame 58 is fitted to the support frame 24, the hoist pins 114 and 116 of the rotary members 106 and 108 disposed in the support frame 24 protrude inwardly through notches 70 and 72 formed in the side walls 64 and 66 of the hoist frame 58. When the rotary members 106 and 108 are rotated, the hoist frame 58 moves up and down between the lowered position shown in FIGS. 1 and 5 and the elevated position shown in FIG. 6. Under the condition shown in FIGS. 1 and 5, the hoist pins 114 and 116 of the rotary members 106 and 108 are positioned at the centers of notches 70 and 72 formed in the side walls 64 and 66 of the hoist frame 58, and do not act on the hoist frame 58. The hoist frame 58 has lowered due to its own weight, and the lower surface of the flange 68 formed at the upper end thereof is brought into contact with the upper edges of the rear wall 28 and side walls 30 and 32 of the support frame 24. The detection arm of the switch 140 detects the recessed portion 138 formed in the cam portion 136 of the rotary member 108 and is opened. The detection arm of the switch 142 is closed by the peripheral surface of cam portion 136 of the rotary member 108. Under the condition shown in FIG. 6, on the other hand, the hoist pins 114 and 116 of the rotary members 106 and 108 are acting on the horizontal edges 75 of notches 70 and 72 formed in the side walls 64 and 66 of the hoist frame 58, whereby the hoist frame 58 is raised to a position shown in the drawing. Under this condition, the detection arm of the switch 142 detects the recessed portion 138 formed in the cam portion 136 of the rotary member 108 and is opened, whereas the detection arm of the switch 140 is closed by the peripheral surface of the cam portion 136 of the rotary member 108. The ascending and descending motions of the hoist frame 58 by the rotary members 106 and 108 will be described later in further detail.

The toner cartridge 16 will now be described with reference to FIGS. 4 and 7 as well as FIG. 1.

The illustrated toner cartridge 16 is equipped with a plastic container 144 which as a whole is made of a single unit or by joining two or more components together. The container 144 has a box-like main portion 146 which contains the toner T. The upper half of the main portion 146 is of a rectangular parallelopiped shape, and the lower half thereof has a truncated pyramidal portion and in succession, a relatively small rectangular parallelopiped portion. In other words, in the lower half of the main portion 146, the four side walls downwardly extend with inward inclination and then downwardly extend substantially vertically. With reference to FIGS. 7 and 8, two toner discharge openings **150*a* and 150*b* are formed side by side in the direction of width (in a direction perpendicularly to the surface of the paper in FIG. 7 or in the right-and-left direction in FIG. 8) in the lower wall 148 of the main portion 146. The toner discharge openings 150*a* and 150*b* may have a rectangular shape. As will be easily comprehended with reference to FIG. 7, the lower wall 148 has a front extended portion 152 and a rear extended portion 154 that extend forwardly and rearwardly. As clearly shown in FIG. 8, melt-adhesion protrusions 156*a* and 156*b* are formed in the lower wall 148 to surround the toner discharge ports 150*a* and 150*b*. Both side portions of the melt-adhesion protrusions 156***a* and 156*b* extend straightly, but the front portions and the rear portions are tilted forward from both sides toward the center in the direction of width to protrude in a triangular shape. Elongated slits 158 and 160 extending in the direction of width are formed in the front extended portion 152 and in the rear extended portion 154 of the lower wall 148 each in a number of two in parallel in the direction of width.

Figure 4:
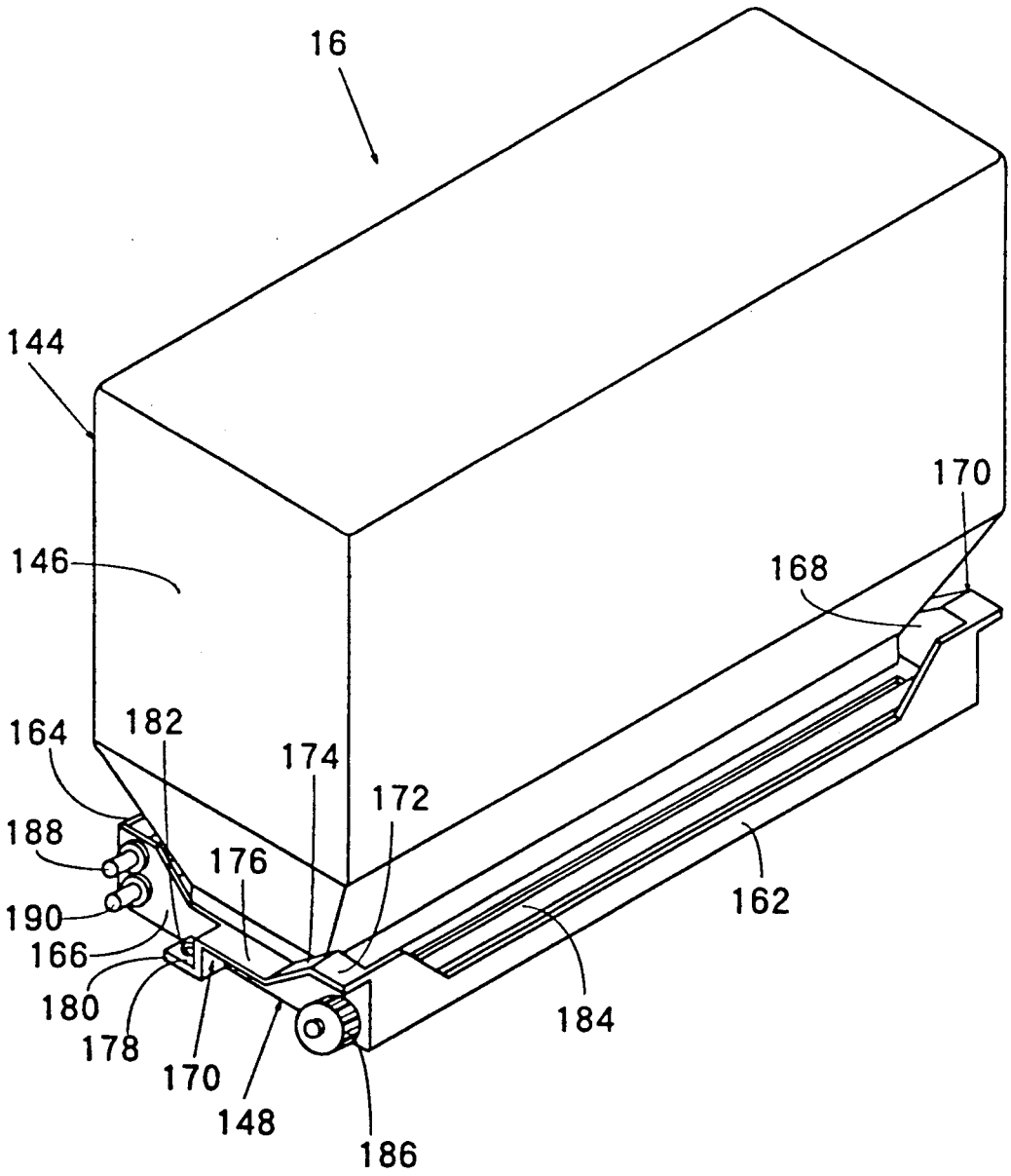
FIG. 4 is a perspective view showing a toner cartridge in the electrostatic latent image-developing device of FIG. 1.
Figure 7:
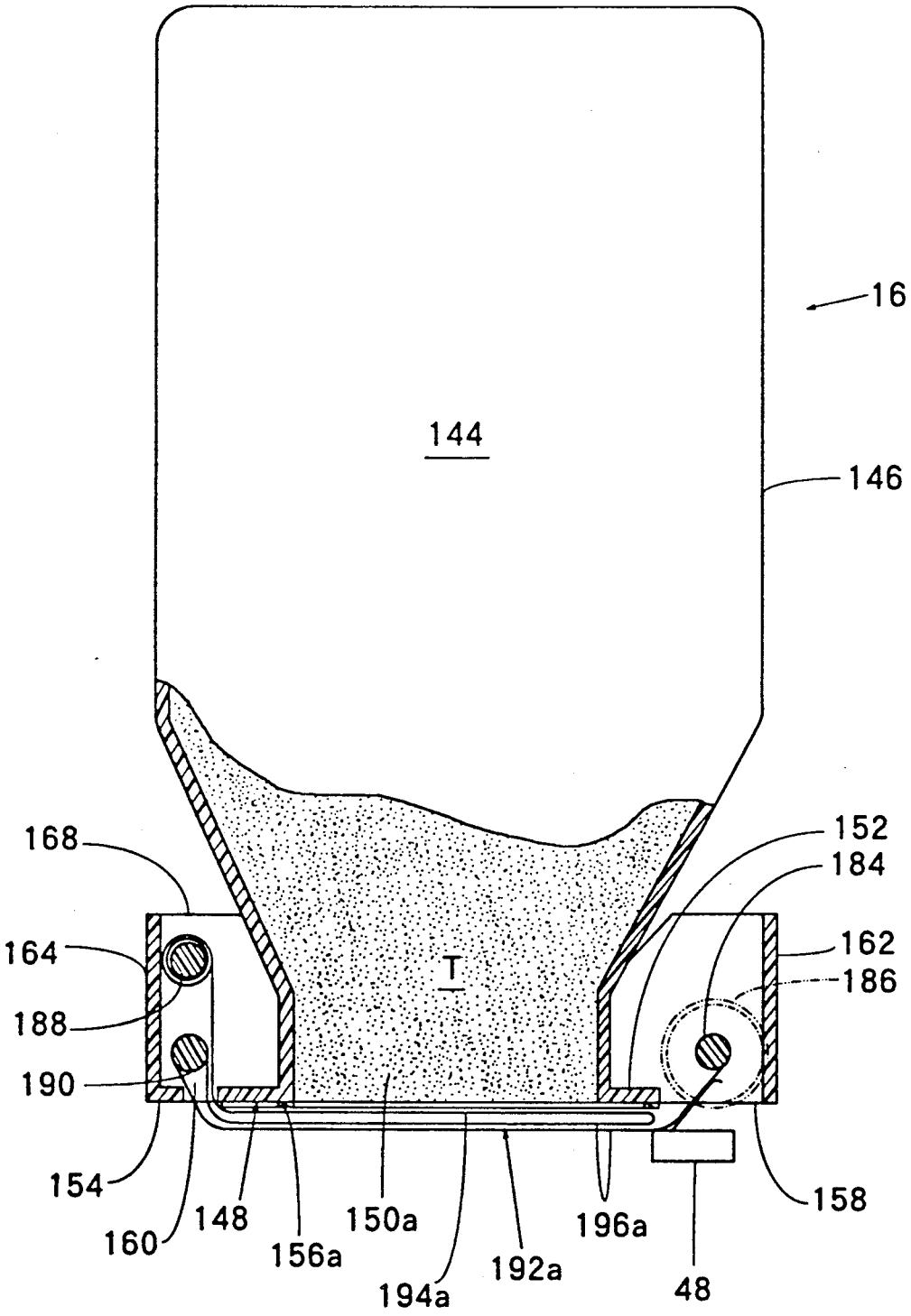
FIG. 7 is a sectional view illustrating the toner cartridge in the electrostatic latent image-developing device of FIG. 1.
Figure 8:
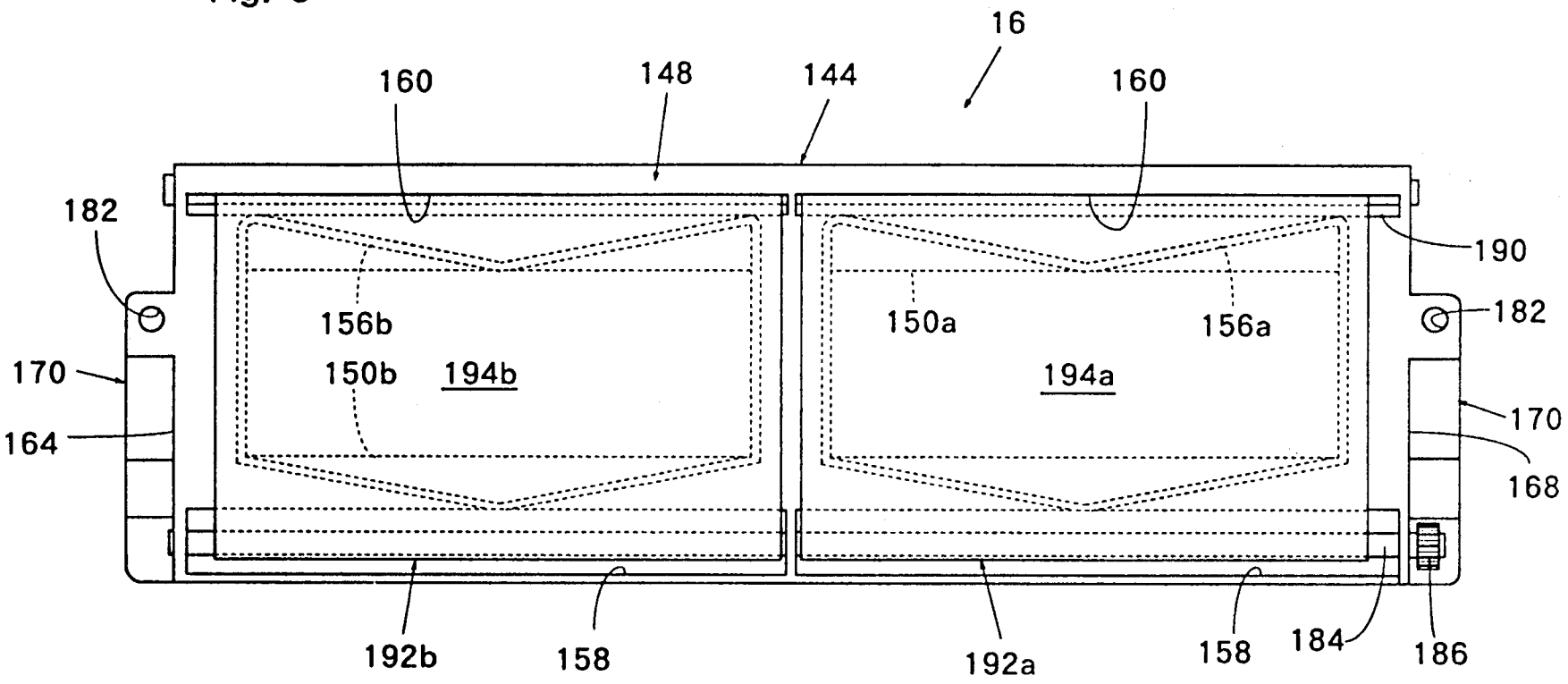
FIG. 8 is a bottom view showing the toner cartridge in the electrostatic latent image-developing device of FIG. 1.

With reference to FIGS. 4, 7 and 8, the lower wall 148 having front extended portion 152 and rear extended portion 154, further has upright walls that upwardly extend substantially vertically from the four peripheral edges thereof, i.e., has front and rear upright walls 162 and 164, as well as upright walls 166 and 168 on both sides. As clearly shown in FIG. 4, protruded walls 170 that protrude outwardly in the direction of width are formed on the outer surfaces of side walls 166 and 168. Each of the protruded walls 170 has an upper horizontal portion 172 that extends substantially horizontally, a tilted portion 174 that extends rearwardly being tilted downwards, an intermediate horizontal portion 176 that rearwardly extends substantially horizontally, a vertical portion 178 that downwardly extends substantially vertically, and a lower horizontal portion 180 that extends substantially horizontally. A positioning hole 182 is formed in the lower horizontal portion 180. A roller 184 that constitutes a take-up means is rotatably mounted between the front portions of the side walls 166 and 168. One end of the roller 184 that extends in the direction of width along the toner discharge openings 150*a* and 150*b* protrudes outwardly through the side wall 166, and a gear 186 is secured to this end. As will be further described later, the gear 186 constitutes an input means which is drivably coupled to the gear 42 arranged in the aforementioned toner cartridge-holding means 14. Rollers 188 and 190 are rotatably mounted between the rear portions of the side walls 166 and 168. The rollers 188 and 190 extend in the direction of width along the toner discharge ports 150*a* and 150*b* at a distance relative to each other in the up-and-down direction. The roller 188 constitutes a delivering means and the roller 190 constitutes a guide means. It is desired that the roller 190 that constitutes the guide means can be rotated with a very small torque, but the roller 188 that constitutes the delivering means is provided with a suitable brake means and is rotated with a torque which is greater than a predetermined value. The brake means will be constituted by a soft material (not shown) that is brought in contact with the roller 188.

Figure 9:
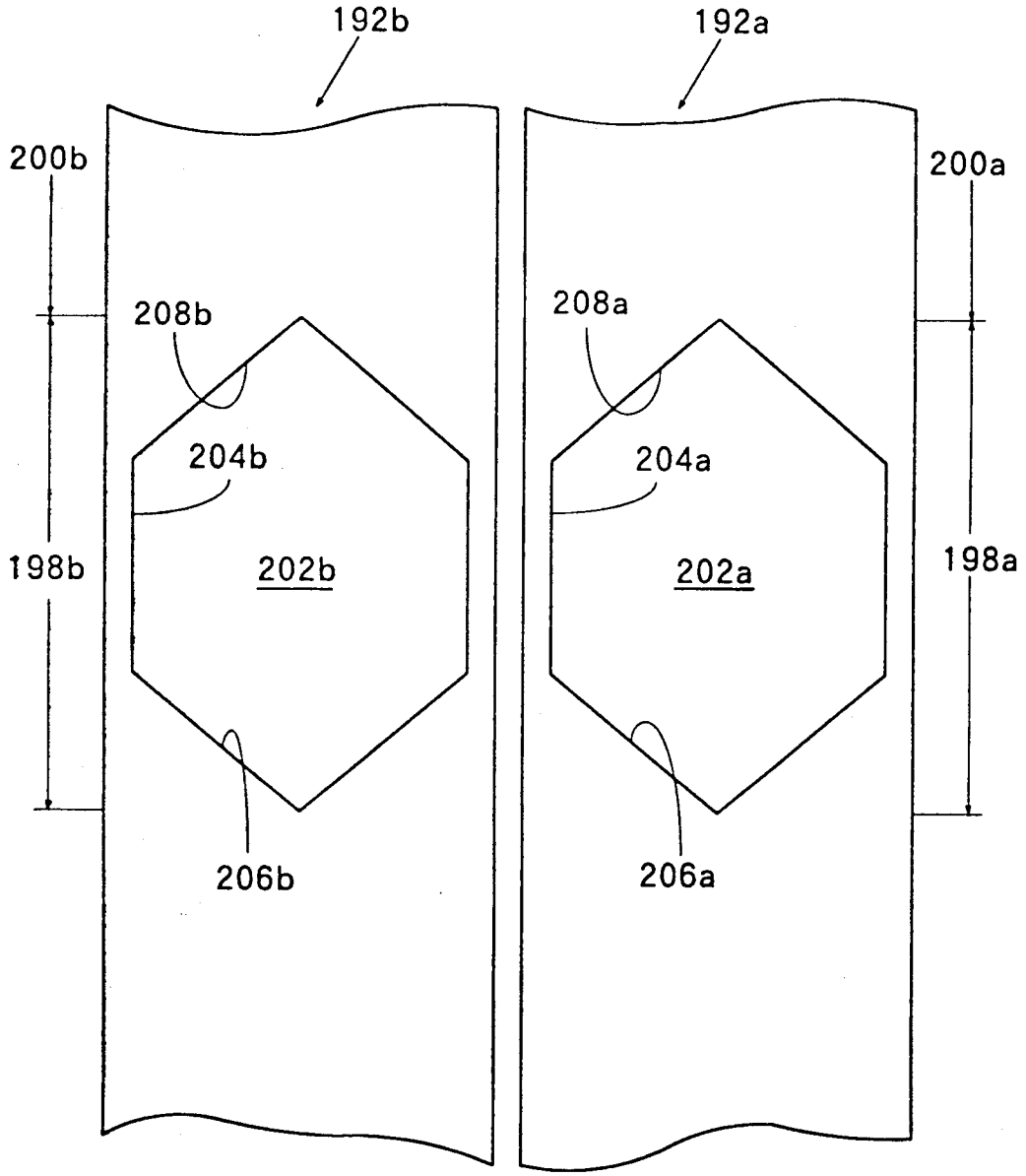
FIG. 9 is a schematic diagram showing a tape member used in the toner cartridge in the electrostatic latent image-developing device of FIG. 1.

With reference to FIGS. 7 and 8, the toner cartridge 16 is further equipped with tape members 192*a* and 192*b* arranged in relation to the toner discharge ports 150*a* and 150*b*. It is desired that the tape members 192*a* and 192*b* that constitute a sealing means are made of a suitable plastic film. The tape members 192*a* and 192*b* are connected at their rear edges by adhesion or any other means to the roller 188 that constitutes the delivering means and are wound on the roller 188 over a required length. The tape members 192*a* and 192*b* extend from the roller 188 through slits 160 formed in the rear extended portion 154 of the lower wall 148, and further extend along the outside of the lower wall 148 to cover the toner discharge openings 150*a* and 150*b*. To the lower wall 148 are peelably stuck the sealing portions 194*a* and 194*b* of the tape members 192*a* and 192*b* that extend along the lower wall 148 to cover the toner discharge openings 150*a* and 150*b*. The peelable sticking is conveniently realized by heating the sealing portions 194*a* and 194*b* of the tape members 192*a* and 192*b* and melt-adhering them to the melt-adhesion protrusions 156*a* and 156*b* formed on the outer surface of the lower wall 148. The tape members 192*a* and 192*b* further have front portions 196*a* and 196*b* that are folded back at the front side (right side in FIG. 7) of the toner discharge openings 150*a* and 150*b* to extend rearwardly, are upwardly guided from the lower wall 148 passing through the slits 160, are wrapped around the roller 190 which constitutes guide means, are downwardly guided to the lower wall 148 passing through the slits 160 to forwardly extend under the lower wall 148, upwardly guided from the lower wall 148 passing through slits 158 formed in the front extended portion 152 of the lower wall 148, and are taken up by the roller 184 that constitutes the take-up means. The front edges of the tape members 192*a* and 192*b* are connected to the roller 184 by adhesion or like means. As schematically shown in FIG. 9, passage opening portions 198*a* and 198*b* as well as tentative-sealing portions 200*a* and 200*b* are included in the portions at the rear of the sealing portions 194*a* and 194*b* of the tape members 192*a* and 192*b*. Toner passage openings 202*a* and 202*b* are formed in the passage opening portions 198*a* and 198*b*. The toner passage openings 202*a* and 202*b* include front side extended portions 206*a*, 206*b* and rear side extended portions 208*a*, 208*b* as well as rectangular central portions 204*a* and 204*b* which are substantially the same as or slightly greater than the toner discharge openings 150*a* and 150*b*. It is desired that the rear side extended portions 208*a* and 208*b* of the toner passage ports 202*a* and 202*b* are gradually narrow rearwardly (the reason will be described later). In the illustrated toner passage ports 202*a* and 202*b*, the rear side extended portions 208*a* and 208*b* has an isosceles triangular shape that become gradually narrow rearwardly, and the front side extended portions 206*a* and 206*b* has an isosceles triangular shape that become gradually narrow toward the front.

The toner cartridge 16 can be fitted to the toner cartridge-holding means 14 in the following manner. First, the cover member 22 at the closed position shown in FIGS. 1 and 5 is turned by hand to the open position shown in FIG. 6 in order to open the opening 20 that is formed in the upper wall of the housing 18. Then, a toner cartridge loading switch that is arranged on an operation panel (not shown) disposed on the front surface of the housing 18 is depressed in order to energize the drive source M2 (FIG. 2) to which the rotary members 106 and 108 are drivably coupled and to turn the rotary members 106 and 108 in the clockwise direction in FIGS. 5 and 6 from the angular position shown in FIG. 5 (i.e., an angular position at which the microswitch 140 detects the recessed portion 138 to be detected of the cam portion 136 that is formed integrally with the rotary member 108). As the rotary members 106 and 108 are rotated to the angular position shown in FIG. 6, the recessed portion 138 to be detected of the cam portion 136 formed integrally with the rotary member 108 is detected by the microswitch 142, whereby the drive source M2 is de-energized and the rotary members 106 and 108 cease to rotate. As will be understood with reference to FIGS. 5 and 6, while the rotary member 106 and 108 are rotated from the angular position shown in FIG. 5 to the angular position shown in FIG. 6, the hoist pins 114 and 116 studded on the rotary members 106 and 108 come in contact with the horizontal edges 75 of the notches 70 and 72 formed in the side walls 64 and 66 of the hoist frame 58 to raise the hoist frame 58 from the lowered position shown in FIG. 5 to the elevated position shown in FIG. 6. Thereafter, the toner cartridge 16 is fitted into the hoist frame 58 that is located at the elevated position, through the opening 20 that is open. As the toner cartridge 16 is inserted in the hoist frame 58, the four corner portions on the bottom wall 148 of the toner cartridge 16 comes in contact with the protrusions 82 and 84 formed at the lower four corner portions of the hoist frame 58. Thus, the toner cartridge 16 is held in the hoist frame 58. As clearly shown in FIG. 6 under the condition where the toner cartridge 16 is fitted to the hoist frame 58 that is located at the elevated position, the upper portion of the toner cartridge 16 protrudes upwardly through the port 20 that is open. Therefore, the toner cartridge 16 can be fitted very easily to the hoist frame 58.

Then, the toner cartridge loading switch (not shown) is depressed again to energize the drive source M2 (FIG. 2) to which the rotary members 106 and 108 are drivably coupled in order to turn the rotary members 106 and 108 in the clockwise direction in FIGS. 5 and 6 from the angular position shown in FIG. 6. As the rotary members 106 and 108 are rotated up to the angular position shown in FIG. 6, the recessed portion 138 to be detected of the cam portion 136 formed integrally with the rotary member 108 is detected by the microswitch 140, whereby the drive source M2 is de-energized and the rotary members 106 and 108 cease to rotate. As will be comprehended with reference to FIGS. 6 and 5, when the rotary members 106 and 108 are rotated in the clockwise direction from the angular position shown in FIG. 6 to the angular position shown in FIG. 5, the hoist pins 114 and 116 studded on the rotary members 106 and 108 move from the horizontal edges 75 of notches 70 and 72 formed in the side walls 64 and 66 of the hoist frame 58 along the arcuate edge 77 and the horizontal edge 76 and then separate away from the edges of notches 70 and 72. The hoist frame 58 is held at the elevated position shown in FIG. 6 while the hoist pins 114 and 116 move along the arcuate edge 77 and the horizontal edge 75, but descends to the lowered position shown in FIG. 5 due to its own weight when the hoist pins 114 and 116 separate away from the edges of notches 70 and 72. According as the hoist frame 58 descends, the toner cartridge 16 fitted thereto descends, too. Here, however, the toner cartridge 16 is limited from descending as the lower wall 148 of the container 144 of the toner cartridge 16 comes in contact with the buffer member 36 arranged on the bottom wall 26 of the stationary support frame 24. When the hoist frame 58 descends to the lowered position shown in FIG. 5, the four corner portions of the lower wall 148 of the container 144 is positioned slightly above the protrusions 82 and 84 provided at the lower four corner portions of the hoist frame 58. Then the hoist pins 114 and 116 separated away from the edges of notches 70 and 72 formed in the side walls 64 and 66 of the hoist frame 58 move along the tilted portion 174 and intermediate horizontal portion 180 of the protruded wall 170 formed on the outer surface of upright side walls 166 and 168 of the container 144, and act on the upper surface of the intermediate horizontal portion 180 to downwardly urge the toner cartridge 16 so that the lower wall 148 of the container 144 is pressed onto the buffer member 36 arranged on the bottom wall 26 of the support frame 24. Thus, the toner cartridge 16 is resiliently held fully reliably at the fitting position shown in FIG. 5. When the toner cartridge 16 is lowered to the fitting position shown in FIG. 5 the positioning pin 38 disposed on the bottom wall 26 of the support frame 24 penetrates through the positioning hole 182 formed in the lower horizontal portion 180 of the protruded wall 170 of the container 144, whereby the toner cartridge 16 is positioned at a required position very precisely, enabling the toner discharge ports **150*a* and 150*b* formed in the lower wall 148 of the container 144 to be in very precise match with the toner-receiving openings 34*a* and 34*b* formed in the bottom wall 26 of the support frame 24. As the toner cartridge 16 is fitted as required to the toner cartridge-holding means 14, the gear 186 (input means) of the toner cartridge 16 is drivably coupled to the gear 42 (output means) of the toner cartridge-holding means 14 and consequently, the roller 184 of the toner cartridge 16 is drivably coupled to the drive source M1. As shown in FIG. 7, furthermore, a portion where the tape member 192*a* of the toner cartridge 16 passes through the slit 158 formed in the front extended portion 152 of the lower wall 148 acts on the detection arm of the switch 48 disposed in the toner cartridge-holding means 14 to close the switch 48**.

Figure 10:
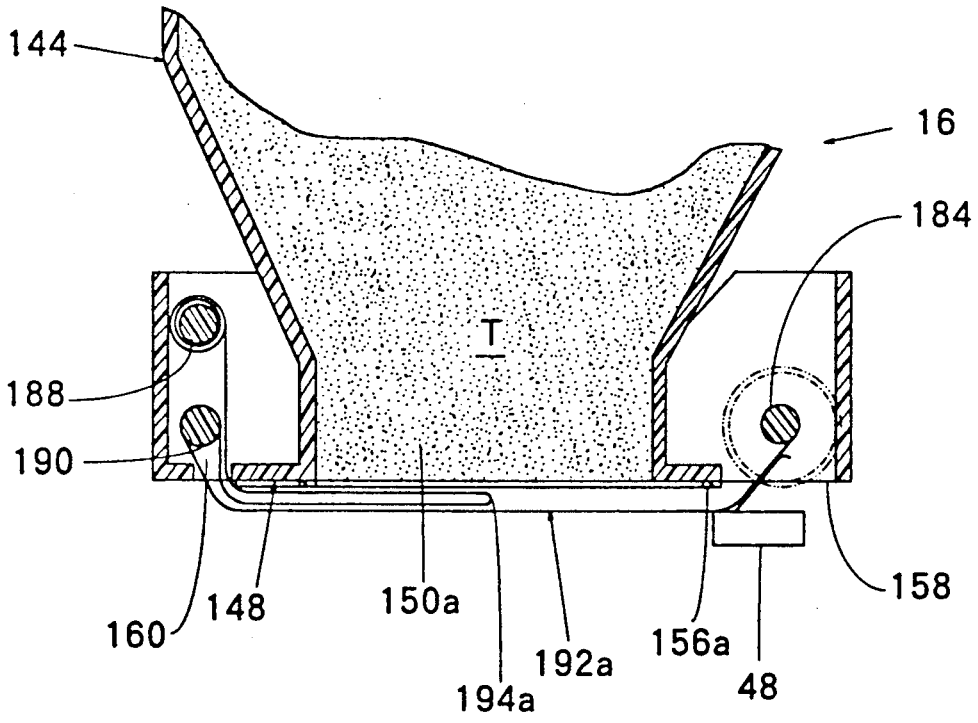
FIG. 10 is a sectional view illustrating the manner of opening a toner discharge opening of the toner cartridge by moving the tape member of the toner cartridge in the electrostatic latent image-developing device of FIG. 1.
Figure 11:
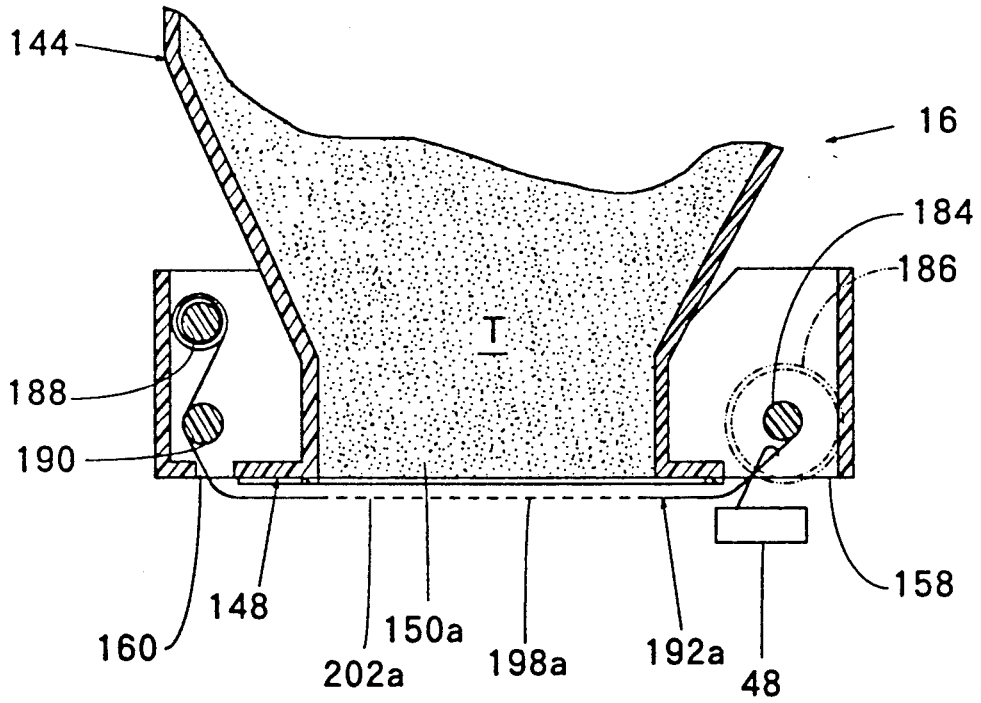
FIG. 11 is a sectional view illustrating the condition where the toner discharge port of the toner cartridge is opened in the electrostatic latent image-developing device of FIG. 1.
Figure 12:
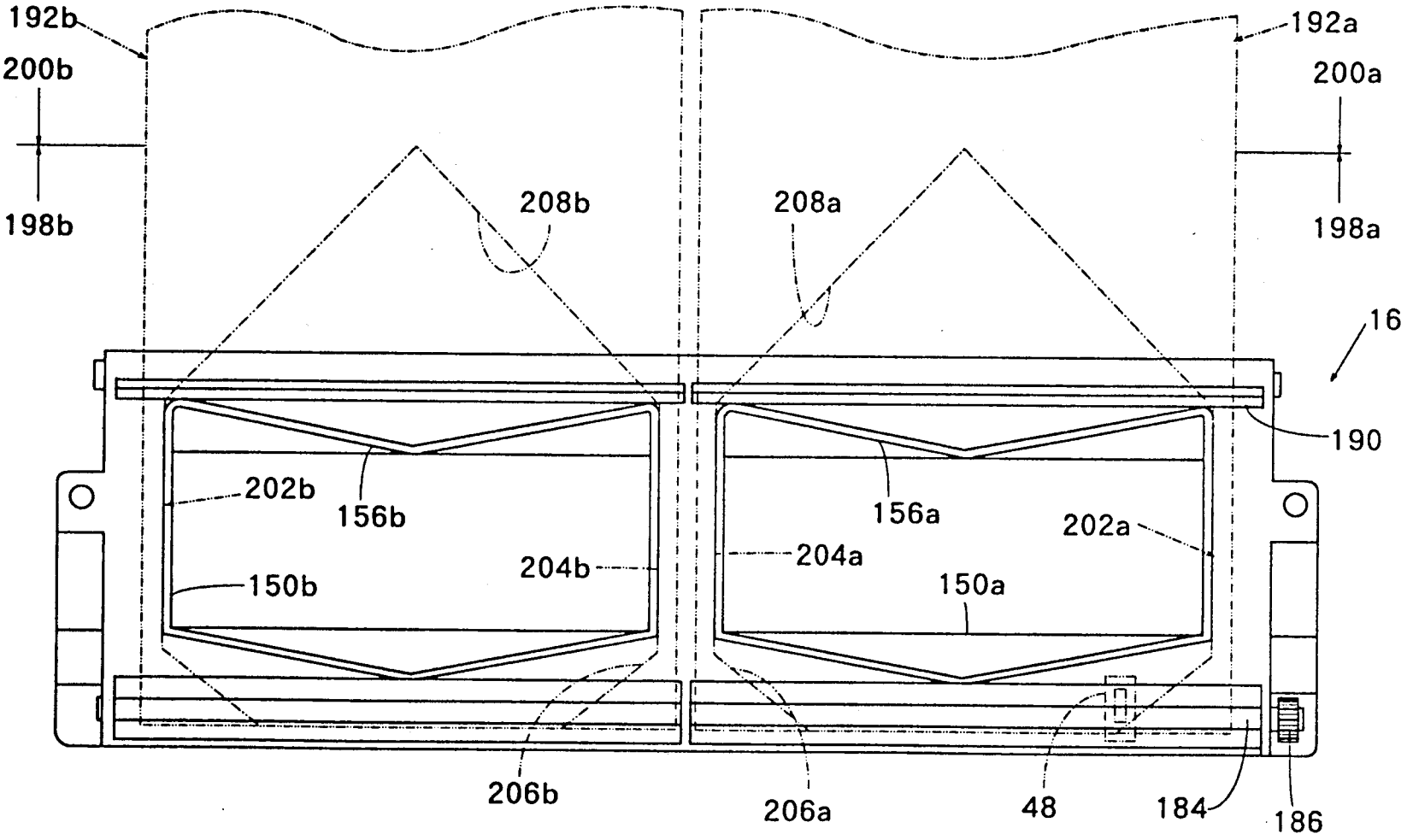
FIG. 12 is a bottom view illustrating the condition where the toner discharge opening of the toner cartridge is opened in the electrostatic latent image-developing device of FIG. 1.

After the toner cartridge 16 has been fitted as required into the toner cartridge-holding means as described above, the operator moves the covering member 22 from the open position shown in FIG. 6 to the closed position shown in FIGS. 1 and 5 and further depresses a toner replenishment switch (not shown) on the operation panel (not shown) disposed on the front surface of the housing 18. Then, the drive source Ml is energized, the roller 184 which constitutes the take-up means in the toner cartridge 16 is rotated in the counter-clockwise direction in FIG. 7, and the tape members **192*a* and 192*b* whose front edges are connected to the roller 184 are taken up by the roller 184. As shown in FIG. 10, by this taking up, the sealing portions 194*a* and 194*b* of the tape members 192*a* and 192*b* are pulled leftwardly in FIGS. 7 and 10 and are peeled off from the lower wall 148 of the container 144. After further taken up, the tape members 192*a* and 192*b* that are delivered from the roller 188 constituting the delivering means pass on the roller 190 that constitutes the guide means, and then pass on the outside of the lower wall 148 of the container 144, as shown in FIG. 11. When the roller 184 is rotated until the tape members 192*a* and 192*b* are placed under a condition shown in FIGS. 11 and 12, the detection arm of the switch 48 disposed in the toner cartridge-holding means 14 protrudes through the toner passage opening 202*a* formed in the tape member 192*a*, and the switch 48 is opened. As the switch 48 is opened, the drive source M1 is de-energized, whereby the roller 184 ceases to rotate and the tape members 192*a* and 192*b* are no more taken up. Under the condition shown in FIGS. 11 and 12, the central portions 204*a* and 204*b* of the toner passage openings 202*a* and 202*b* formed in the tape members 192*a* and 192*b* are brought in match with the toner discharge openings 150*a* and 150*b* formed in the lower wall 148 of the container 144 and, thus, the toner discharge openings 150*a* and 150*b* are opened (in FIG. 11, the passage opening portions 198*a* and 198*b* of the tape members 192*a* and 192*b* in which the toner passage openings 202*a* and 202*b* are formed are indicated by a two-dot chain line for the purpose of convenience). As the toner discharge openings 150*a* and 150*b* are opened, the toner T contained in the container 144 is discharged downwards through the toner discharge openings 150***a* and 150*b* and toner passage openings 202*a* and 202*b*, and is fed into the toner carrier unit 6 through the toner-receiving openings 34*a* and 34*b* formed in the bottom wall 26 of the toner cartridge-holding means 14.

Figure 13:
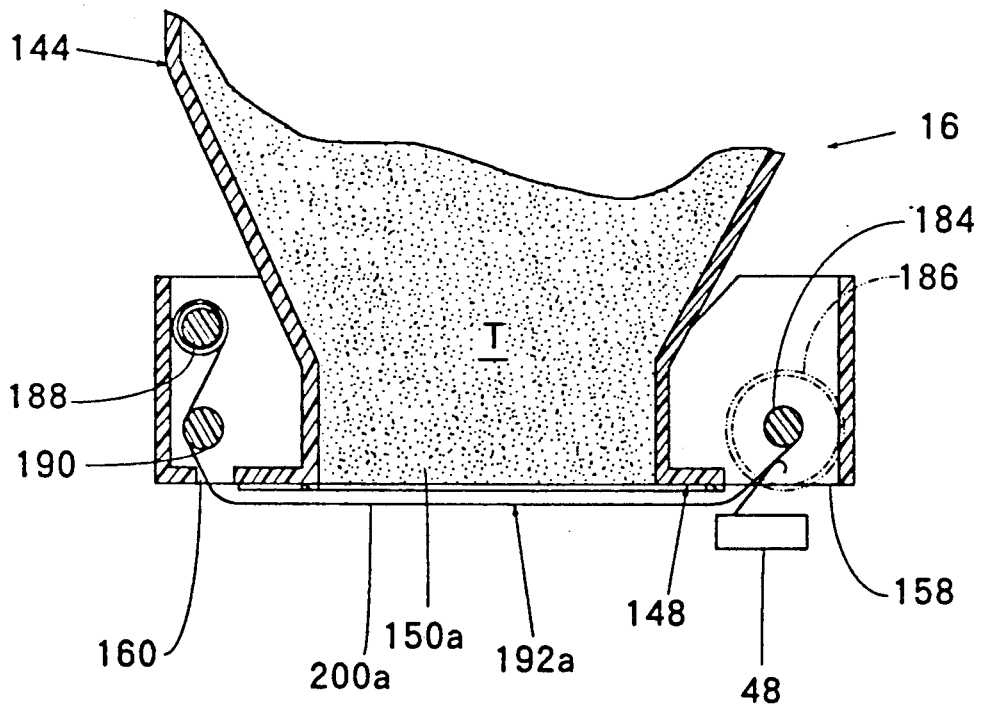
FIG. 13 is a sectional view illustrating the condition where the toner discharge opening of the toner cartridge is shut again by moving the tape member of the toner cartridge in the electrostatic latent image-developing device of FIG. 1.

When the toner T contained in the container 144 of the toner cartridge 16 is completely consumed and so it becomes necessary to renew the toner cartridge 16 (the necessity of renewal can be found by detecting, for example, the toner in the toner carrier unit 6), the toner replenishment switch (not shown) is depressed. Then the drive source M1 (FIG. 2) is energized the roller 184 constituting the take-up means in the toner cartridge 16 is rotated in the counterclockwise direction in FIGS. 11 and 13, and the tape members 192*a* and 192*b* are taken up by the roller 184. When the rear ends of passage opening portions 198*a* and 198*b* of the tape member 192*a* and 192*b* that are taken up, pass over the detection arm of the switch 48 of the toner cartridge-holding means 14, i.e., when the rear extended portion 208*a* of toner passage opening 202*a* formed in the passage opening portion 198*a* of the tape member 192*a* pass over the detection arm of the switch 48, the non-opening portion of the tape member 192*a* acts on the detection arm of the switch 48 so that the switch 48 is closed. After the lapse of some periods of time from when the switch 48 is closed, the drive source M1 is de-energized, and the tape members 192*a* and 192*b* are no more taken up and assume the condition as shown in FIG. 13. Under the condition shown in FIG. 13, the passage opening portions 198*a* and 198*b* of the tape members 192*a* and 192*b* are taken up by the roller 184, and the tentative sealing portions 200*a* and 200*b* of the tape members 192*a* and 192*b* cover the toner discharge openings 150*a* and 150*b* formed in the lower wall 148 of the container 144. The toner passage openings 202*a* and 202*b* formed in the tape members 192*a* and 192*b* have rear extended portions 208*a* and 208*b* of an isosceles triangular shape that become gradually narrow rearwardly. Therefore, when the toner passage openings 198*a* and 198*b* pass on the toner discharge openings 150*a* and 150*b* formed in the lower wall 148 of the container 144, the tape members 192*a* and 192*b* can be taken up fully smoothly without encountering such a problem that the rear edges of the toner passage openings 202*a* and 202*b* are caught by the front edges of the toner discharge openings 150*a* and 150*b*. When the toner passage openings 202*a* and 202*b* do not have rear extended portions 208*a* and 208*b*, the straight rear edges at the central portions 204*a* and 204*b* of the toner passage openings 202*a* and 202*b* may be displaced into the toner discharge openings 150*a* and 150*b* and caught by the front edges of the toner discharge openings 150*a* and 150*b*.

Next, the cover member 22 disposed on the upper wall of the housing 18 is turned to the open position shown in FIG. 6 to open the opening 20 formed in the upper wall of the housing 18. Then, the toner cartridge loading switch (not shown) is depressed. Then, the hoist frame 58 is raised to the elevated position shown in FIG. 6 in a manner as described above, and the toner cartridge 16 is raised to the elevated position shown in FIG. 6, too. Thereafter, the depleted toner cartridge 16 in which the toner T was consumed is removed from the hoist frame 58 and a new toner cartridge 16 is fitted to the hoist frame 58. When the hoist frame 58 is raised to the elevated position shown in FIG. 6, the upper half portion of the depleted toner cartridge 16 protrudes upwardly beyond the opening 20 formed in the upper wall of the housing 18. It is therefore allowed to very easily remove the depleted toner cartridge 16 from the hoist frame 58. In the depleted toner cartridge 16, the toner discharge openings 150*a* and 150*b* formed in the lower wall 148 of the container 144 have been closed by the false-sealing portions 200*a* and 200*b* of the tape members 192*a* and 192*b*. Therefore, the toner T that may remain in small amounts in the container 144 is prevented from scattering around. After the new toner cartridge 16 is fitted to the hoist frame 58 located at the elevated position, the hoist frame 58 is lowered in a manner as described above. The new toner cartridge 16 is then fitted as required to the toner cartridge-holding means 14, and the toner discharge openings 150*a* and 150*b* of the container 144 are opened to feed the toner again to the toner carrier unit 6.

A preferred embodiment of the electrostatic latent image-developing device and the toner cartridge constituted according to the present invention was described above in detail with reference to the accompanying drawings. It, however, needs not be pointed out that the present invention is in no way limited to the above embodiment only but can be modified or changed in a variety of other ways without departing from the scope of the present invention.

In the above embodiment for instance, the hoist frame 58 is disposed in the toner cartridge-holding means 14, and the toner cartridge 16 is raised and lowered while being held in the hoist frame 58. However, it is also allowable to directly raise and lower the toner cartridge 16 without employing the hoist frame 58.

In the above embodiment, furthermore, the input means (gear 186) of the toner cartridge 16 is drivably coupled to the output means (gear 42) of the toner cartridge-holding means 14 when the toner cartridge 16 is fitted as required, and the tape members 192*a* and 192*b* in the toner cartridge 16 are taken up by the roller 184 which is driven by the drive source M1 such as an electric motor provided in the toner cartridge-holding means 14. It is, however, also allowable to constitute the device in a manner as described below instead of the above-mentioned constitution. For instance, a rack extending in the up-and-down direction is disposed in the stationary support frame 24 in the toner cartridge-holding means 14, so that the gear 186 of the toner cartridge 16 is rotated by the action of the rack at the time when the toner cartridge 16 is manually or automatically raised or lowered, causing the roller 184 to be rotated to take up the tape members 192*a* and 192*b*. Or, the covering member 122 disposed on the upper surface of the housing 18 is provided with a gear, and the rotation of this gear produced by the opening or closure of the covering member 122 is transmitted to the gear 186 of the toner cartridge 16 fitted in the toner cartridge-holding means 14 via a suitable transmission means, in order to rotate the roller 184 and to take up the tape members 192*a* and 192*b*.

In the above embodiment, furthermore, the tape members 192*a* and 192*b* are wrapped round the rollers 184, 188 and 190 of the container 144 in a predetermined manner, the tape members 192*a* and 192*b* having sealing portions 194*a*, 194*b* and passage openings 198*a*, 198*b*, as well as front portions 196*a*, 196*b* and tentative sealing portions 200*a*, 200*b*. It is, however, also allowable to wrap up the tape members 192*a* and 192*b* without using the roller 190, or to wrap up the tape members 192*a* and 192*b* by employing one or two or more additional rollers. In the above embodiment, furthermore, the toner discharge openings 150*a* and 150*b* are closed by the tentative sealing portions 200*a* and 200*b* of the tape members 192*a* and 192*b* after the toner T in the container 144 is consumed. It is, however, further allowable to close the toner discharge openings 150*a* and 150*b* by moving the tape members 192*a* and 192*b* in the opposite direction so that the sealing portions 194*a* and 194*b* are positioned at the toner discharge openings 150*a* and 150*b* after the toner T in the container 144 is consumed.

What we claim is:

1. An electrostatic latent image-developing device comprising a toner cartridge-holding means and a toner cartridge detachably fitted to said toner cartridge-holding means, said toner cartridge including a container with a toner discharge opening, toner contained in said container, and a sealing means for sealing said toner discharge opening, said toner cartridge-holding means having a toner-receiving opening, and said toner discharge opening being positioned opposed to said toner-receiving opening when said toner cartridge is fitted to a predetermined fitting position of said toner cartridge-holding means, wherein said sealing means is constituted by a tape member that is provided to move across said toner discharge opening, a toner passage opening is formed in said tape member, and said toner is discharged from said container into said toner-receiving opening through said toner discharge opening and said toner passage opening when said tape member is so moved that said toner passage opening is located at said toner discharge opening.

2. An electrostatic latent image-developing device according to claim 1, wherein said toner cartridge is provided with a take-up means to which the front edge of said tape member is connected, and said tape member is moved across said toner discharge opening by the action of said take-up means.

3. An electrostatic latent image-developing device according to claim 2, wherein said take-up means has an input means, said toner cartridge-holding means is provided with an output means which is connected to a drive source, said output means and said input means are drivably coupled together when said toner cartridge is fitted to the fitting position of said toner cartridge-holding means, and said take-up means is rotated by the operation of said drive source to move said tape member.

4. An electrostatic latent image-developing device according to claim 3, wherein said input means and said output means are constituted by gears.

5. An electrostatic latent image-developing device according to claim 2, wherein said toner cartridge is equipped with a delivering means which is rotatable and is wrapped with said tape member and a guide means which guides said tape member, said delivering means and said guide means are disposed on the side of one edge of said toner discharge opening, said take-up means is disposed on the side of the other edge of said toner discharge opening, said tape member includes a sealing portion which under the initial condition, extends from the side of said one edge of said toner discharge opening along the outside thereof across said toner discharge opening and is peelably stuck to said container around the peripheral edge of said toner discharge opening, a passage opening portion which is located behind said sealing portion and in which said toner passage opening is formed, and a front portion which is folded back at the front edge of said sealing portion, passes along the outer side thereof, turns around said guide means and extends up to said take-up means, and when said toner discharge opening is to be opened, said sealing portion of said tape member is peeled off from said container, and said front portion and said sealing portion of said tape member are taken up by said take-up means by means of the tape member taking-up operation of said take-up means, so that said passage port portion of said tape member extends across said toner discharge opening.

6. An electrostatic latent image-developing device according to claim 5, wherein said tape member includes a tentative sealing portion located behind said passage opening portion, and when said toner cartridge is to be taken out from said toner cartridge-holding means, said passage opening portion of said tape member is taken up by said take-up means by means of the tape member taking-up operation of said take-up means prior to removing said toner cartridge, so that said tentative sealing portion extends across said toner discharge opening.

7. An electrostatic latent image-developing device according to claim 5, wherein said take-up means, said delivering means and said guide means are constituted by rollers that are rotatably mounted and extend along said toner discharge opening.

8. An electrostatic latent image-developing device according to claim 1, wherein the rear end portion of said toner discharge opening formed in said tape member becomes gradually narrow toward the rear side.

9. An electrostatic latent image-developing device according to claim 1, wherein two toner discharge openings are formed in said container of said toner cartridge side by side in the direction of width, and two tape members are arranged side by side in the direction of width in relation to said toner discharge openings.

10. An electrostatic latent image-developing device according to claim 1, wherein said toner cartridge-holding means is provided with a hoist means which moves said toner cartridge up and down between said fitting position and the elevated position raised from said fitting position.

11. An electrostatic latent image-developing device according to claim 10, wherein said hoist means includes a hoist frame that is mounted thereon to move up and down, and said toner cartridge is fitted to said hoist frame.

12. An electrostatic latent image-developing device according to claim 10, wherein said toner cartridge-holding means has a bottom wall in which said toner-receiving opening is formed, a buffer member is disposed on said bottom wall, said toner discharge opening is formed in the lower wall of said container of said toner cartridge, and said lower wall of said container is pressed onto said buffer member when said toner cartridge is lowered to said fitting position by the operation of said hoist means.

13. An electrostatic latent image-developing device according to claim 10 wherein an opening is formed over said toner cartridge-holding means, said opening being closed by a covering member that can be freely opened and shut, and said toner cartridge upwardly protrudes partly beyond said opening when said covering member is opened and said toner cartridge is raised to said elevated position.

14. An electrostatic latent image-developing device comprising a toner cartridge-holding means and a toner cartridge detachably fitted to said toner cartridge-holding means, said toner cartridge including a container with a toner discharge opening, toner contained in said container, and a sealing means for sealing said toner discharge opening, said toner cartridge-holding means having a toner-receiving port, and said toner discharge opening being positioned opposed to said toner-receiving opening when said toner cartridge is fitted to a predetermined fitting position of said toner cartridge-holding means, wherein said toner cartridge-holding means is provided with a hoist means which moves said toner cartridge up and down between said fitting position and the elevated position raised from said fitting position.

15. An electrostatic latent image-developing device according to claim 14, wherein said hoist means includes a hoist frame that is mounted thereon to move up and down, and said toner cartridge is fitted to said hoist frame.

16. An electrostatic latent image-developing device according to claim 14, wherein said toner cartridge-holding means has a bottom wall in which said toner-receiving opening is formed, a buffer member is arranged on said bottom wall, said toner discharge opening is formed in the lower wall of said container of said toner cartridge, and said lower wall of said container is pressed onto said buffer member when said toner cartridge is lowered to said fitting position by the operation of said hoist means.

17. An electrostatic latent image-developing device according to claim 14, wherein an opening is formed over said toner cartridge-holding means, said opening being closed by a covering member that can be freely opened and shut, and said toner cartridge upwardly protrudes partly beyond said opening when said covering member is opened and said toner cartridge is raised to said elevated position.

18. A toner cartridge comprising a container with a toner discharge opening toner contained in said container, and a sealing means for sealing said toner discharge opening, wherein said sealing means is constituted by a tape member that is provided to move across said discharge opening, a toner passage opening is formed in said tape member, and said toner is discharged from said container through said toner discharge opening and said toner passage opening when said tape member is so moved that said toner passage opening is located at said toner discharge opening.

19. A toner cartridge according to claim 18, wherein provision is made of a take-up means to which the front edge of said tape member is connected, and said tape member is moved across said toner discharge opening by the action of said take-up means.

20. A toner cartridge according to claim 19, wherein provision is made of a delivering means which is rotatable and is wrapped with said tape member and a guide means which guides said tape member, said delivering means and said guide means are disposed on the side of one edge of said toner discharge opening, said take-up means is disposed on the side of the other edge of said toner discharge opening, said tape member includes a sealing portion which under the initial condition, extends from the side of said one edge of said toner discharge opening along the outside thereof across said toner discharge opening and is peelably stuck to said container around the peripheral edge of said toner discharge opening, a passage opening portion which is located behind said sealing portion and in which said toner passage opening is formed, and a front portion which is folded back at the front edge of said sealing portion, passes along the outer side thereof, turns around said guide means and extends up to said take-up means, and when said toner discharge opening is to be opened, said sealing portion of said tape member is peeled off from said container and said front portion and said sealing portion of said tape member are taken up by said take-up means by means of the tape member taking-up operation of said take-up means, so that said passage port portion of said tape member extends across said toner discharge opening.

21. A toner cartridge according to claim 20, wherein said tape member includes a tentative sealing portion located behind said passage opening portion, and after said passage opening portion of said tape member is allowed to extend across said toner discharge opening, said passage opening portion of said tape member is taken up by said take-up means by means of the tape member taking-up operation of said take-up means, so that said tentative sealing portion extends across said toner discharge opening.

22. A toner cartridge according to claim 20, wherein said take-up means said delivering means and said guide means are constituted by rollers that are rotatably mounted and extend along said toner discharge opening.

23. A toner cartridge according to claim 18, wherein the rear end portion of said toner discharge opening formed in said tape member becomes gradually narrow toward the rear side.

24. A toner cartridge according to claim 18, wherein two toner discharge openings are formed in said container in the direction of width in parallel with each other, and two tape members are arranged in the direction of width in parallel with each other in relation to said toner discharge openings.

* * * * *